United States Patent [19]

Andrews

[11] 3,996,920

[45] Dec. 14, 1976

[54] FIREPLACE DAMPER CONSTRUCTION

[75] Inventor: George M. Andrews, Syracuse, N.Y.

[73] Assignee: Vega Industries, Inc., Syracuse, N.Y.

[22] Filed: Jan. 16, 1976

[21] Appl. No.: 649,858

[52] U.S. Cl. ..... 126/285 A; 126/286; 126/288

[51] Int. Cl.[2] ..... F23L 13/06

[58] Field of Search ..... 126/288, 285 A, 295, 126/286, 120; 110/163

[56] References Cited

UNITED STATES PATENTS

| | | | |
|---|---|---|---|
| 741,474 | 10/1903 | Ferry | 126/286 |
| 926,048 | 6/1909 | Champion | 126/288 |
| 1,506,386 | 8/1924 | Schauman | 126/285 A |
| 1,507,473 | 9/1924 | Dray | 126/288 |
| 3,269,384 | 8/1966 | Adelt | 126/288 |

*Primary Examiner*—John J. Camby
*Assistant Examiner*—Larry I. Schwartz
*Attorney, Agent, or Firm*—Charles S. McGuire

[57] ABSTRACT

A damper construction is provided by a sheet metal plate having fixed guide members extending therefrom for sliding movement upon a pair of parallel guide tracks on each side of the plate. The tracks extend horizontally on each side of the flue opening and slope downwardly toward the upper edge of the open front of the fireplace. The plate is movable between positions fully covering and uncovering the flue opening when the guide members are disposed in the horizontal and downwardly sloping portions, respectively, of the tracks. A handle is attached at one end to the center of the front edge of the plate for limited pivotal movement about two perpendicular axes to allow access to the other end of the handle in either position of the plate, and to allow movement of the handle to a position out of the frontal fireplace opening when the plate is in the uncovering position.

9 Claims, 6 Drawing Figures

FIREPLACE DAMPER CONSTRUCTION

BACKGROUND OF THE INVENTION

The present invention relates to dampers for open front fireplaces and, more particularly, to a damper construction wherein a movable sheet metal plate serves to close the flue opening in one position and provides a radiation shield in the other.

In so-called "factory built" or prefabricated fireplaces, proper insulation and air flow patterns must be provided to insure that the outer shell of the fireplace does not exceed certain acceptable temperature limits. Open spaces for flow of cooling air are commonly provided under the hearth and on the sides and rear of the usual type of open front fireplace. However, the upper front area, i.e., the portion immediately above the top edge of the frontal opening, is one of the most difficult to cool properly. Accordingly, it is desirable to provide any means which may be included without inordinately increasing the cost to improve the temperature control in the upper front area of the fireplace, particularly those of the factory built type.

It is a principal object of the present invention to provide a factory built fireplace with improved means for limiting the heat passing through the inner frontal fireplace walls without significantly increasing the cost.

A further object is to provide a fireplace damper construction wherein a flue closure plate serves to improve the control of heat in the upper front area of the fireplace when in the open position.

Another object is to provide a damper construction having a plate movable only between fully open and fully closed positions with respect to the flue opening and having an attached handle movable about two axes with respect to the plate for convenience of both access and storage.

Other objects will in part be obvious and will in part appear hereinafter.

SUMMARY OF THE INVENTION

In accordance with the foregoing objects, the invention comprises a substantially flat, sheet metal plate having pins, or other such guide members, extending fixedly from each of two side edges, adjacent both the front and rear of the plate. The pins rest upon a pair of parallel guide tracks having first portions horizontally disposed along the sides of the flue opening, and second portions sloping downwardly from the first portions toward the rear side of the upper edge of the fireplace frontal opening.

The plate is movable between a position wherein it fully covers the flue opening with the guide pins disposed upon the first portion of the tracks, and a position wherein the flue opening is completely uncovered. In the latter position the plate is disposed in a plane parallel to the second portion of the guide tracks, directly below the inner front portion of the fireplace. In this position the plate shields the inside wall of the fireplace, above and behind the upper edge of the frontal opening, from direct heat from the fire.

A handle is attached to the movable plate at the center of the front edge thereof for pivotal movement about either of two perpendicular axes. Movement about the axis parallel to the front edge of the plate is limited by contact of the pivoted end with the plate, when the latter covers the flue opening, to position the free end directly behind and below the upper edge of the frontal opening of the fireplace. Movement about the perpendicular axis allows the handle to be positioned out of the fireplace frontal opening when the plate is in the open or uncovering position.

DETAILED DESCRIPTION

Figure 1:
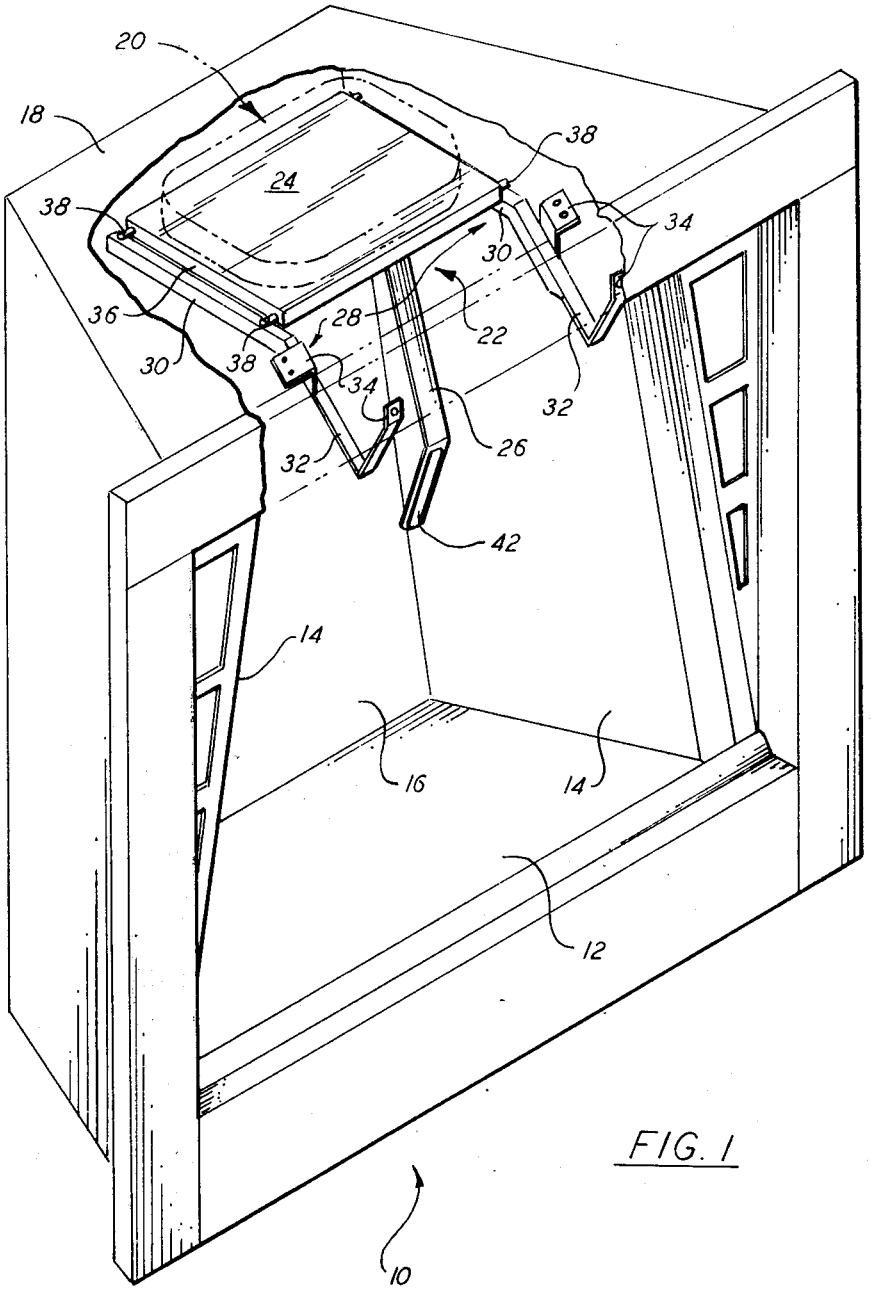
FIG. 1 is a perspective view, with portions broken away, of a typical fireplace construction embodying the damper of the present invention.

Referring now to the drawings, in FIG. 1 is shown a typical factory built fireplace 10, having the usual hearth floor 12, side walls 14 and rear wall 16 defining a firebox with an open front. Although the invention is not limited to employment with any specific type of fireplace, it is illustrated in connection with a factory built fireplace of the type shown in applicant's copending application Ser. No. 593,799, filed July 7, 1975. Upper wall 18 of fireplace 10 includes flue opening 20 with which a dome structure and/or chimney sections are placed in mating engagement when the fireplace is permanently installed in a structure, and through which the products of combustion are exhausted. The upper portions of the side and rear walls include louvered openings 21 through which cooling air which has circulated outside the firebox walls is also exhausted through opening 20.

Fireplace 10 includes a damper construction, denoted generally by reference numeral 22, for selectively covering and uncovering flue opening 20. Damper 22 is generally comprised of flat plate 24, handle 26 and guide tracks 28 each having first portions 30 and second portions 32. Tracks 28 are fixedly secured in parallel relation to the inside, upper wall of the fireplace, first portions 30 being secured in a horizontal plane on opposite sides of opening 20, and second portions 32 being secured by brackets 34 to an inner wall portion forwardly of opening 20. In the illustrated embodiment tracks 28 are in the form of inwardly facing channel members, but other configurations are equally suitable.

Plate 24 is square or rectangular in the illustrated embodiment and includes bent-over edge portions forming flanges 36 around the front, rear and side edges. Two pins 38 extend fixedly from each of flanges 36 along the side edges, one pin adjacent each of the front and rear edges on both sides. Tracks 28 are spaced apart slightly farther than the width of plate 24 so that pins 38 extend outwardly to rest upon the tracks. Thus, plate 24 is movable along tracks 28 with pins 38 riding upon the tracks, which guide and laterally constrain movement of the plate.

Figure 2:
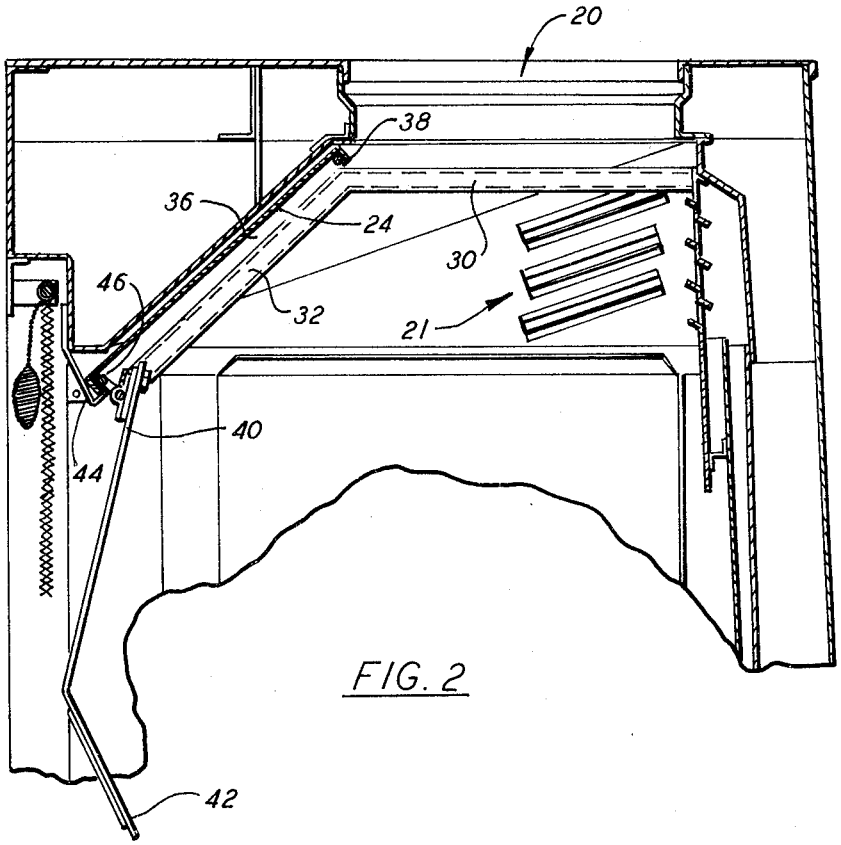
FIGS. 2 and 3 are fragmentary, side elevational views, in vertical section through a central portion of the fireplace, showing the damper plate in the open position and the handle in two positions of its movement.
Figure 3:
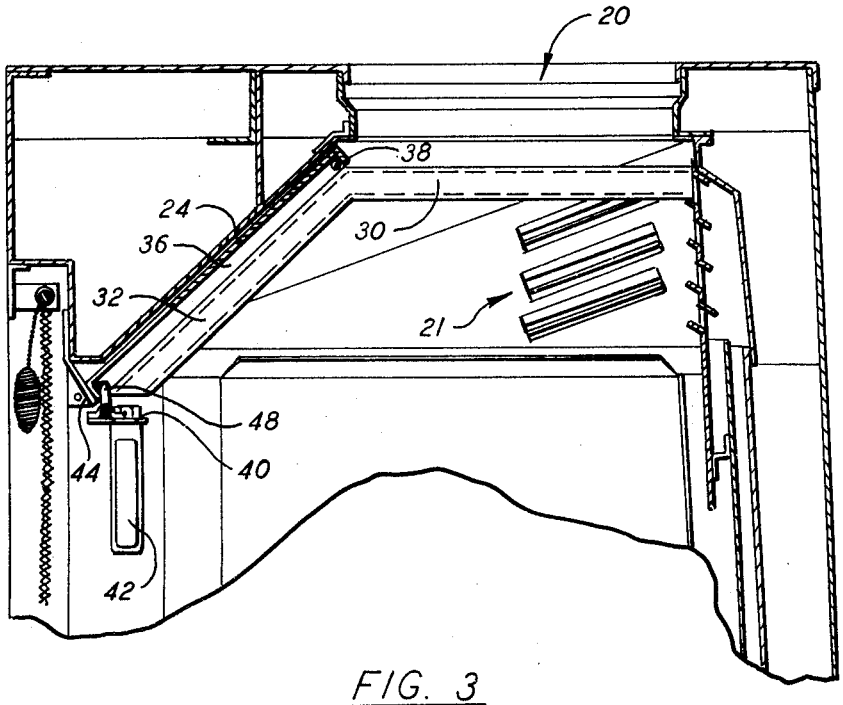
Figure 4:
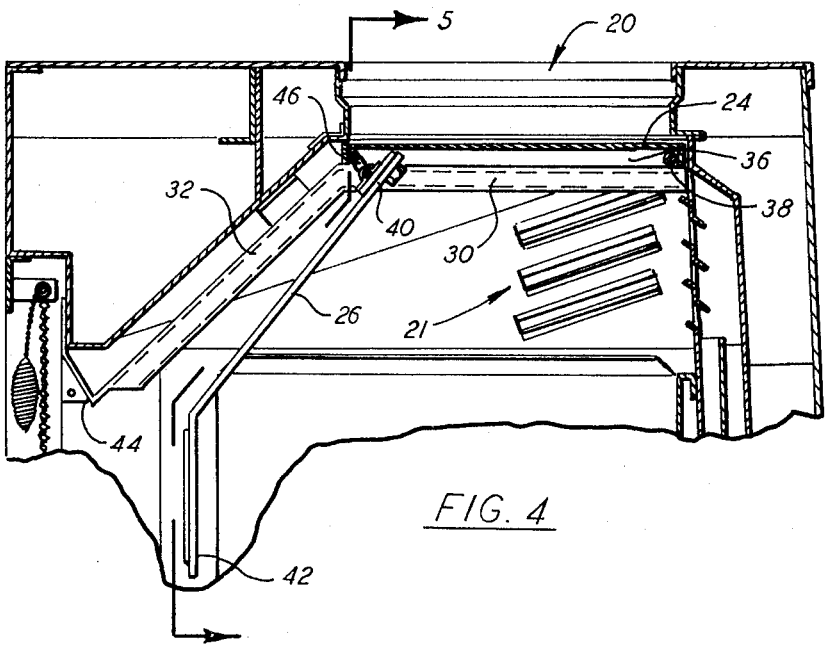
FIG. 4 is a fragmentary, side elevational view in section as in FIGS. 2 and 3, showing the damper plate in the closed position.
Figure 5:
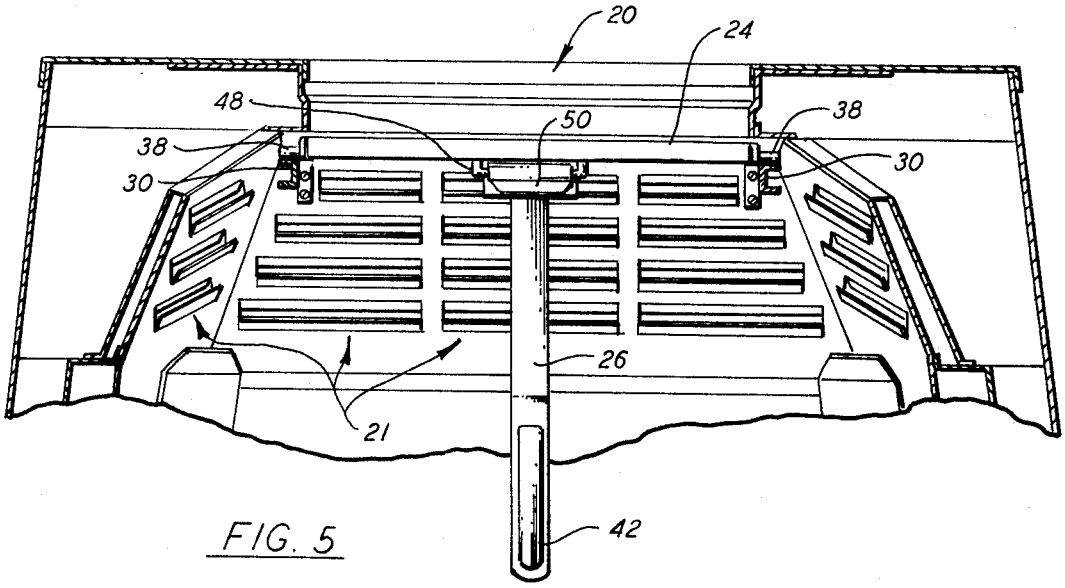
FIG. 5 is a fragmentary, front elevational view in section on the line 5—5 of FIG. 4.

As seen more clearly in FIGS. 2–5, handle 26 is pivotally connected at one end 40 to plate 24 adjacent the front edge thereof in a manner explained later in more detail. Handle 26 may be grasped at free end 42 to effect movement of plate 24 between the open or uncovering position (with respect to opening 20) shown in FIGS. 2 and 3, and the covering position, wherein the plate is shown in FIGS. 4 and 5.

Movement of plate 24 to the open position is limited by contact of flange 36 across the front edge of the plate with fixed member 44, extending across the upper edge of the frontal opening of the fireplace. In this position the two pins 38 adjacent the front edge of the plate rest upon the lowermost ends of second portions 32 of guide tracks 28, and the two pins 38 adjacent the rear edge of the plate are at or near the junction between the first and second portions of the tracks. In the closed position, wherein plate 24 is pictured in FIGS. 4 and 5, all four of pins 38 rest upon the upper sides of first portions 30 of the tracks, and the plate completely covers opening 20.

Figure 6:
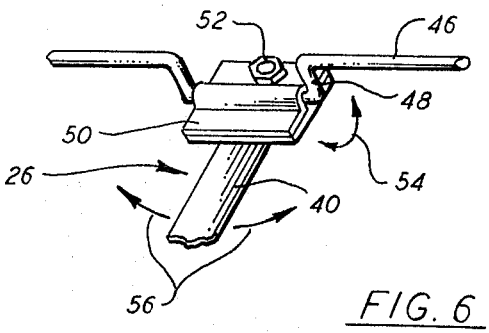
FIG. 6 is an enlarged, fragmentary, perspective view showing in more detail the connection of the handle to the damper plate.

Referring now to FIG. 6, the mounting of end 40 of handle 26 is shown in greater detail. Rod 46 may be attached by suitable brackets, or the like, to the underside of plate 24 near the front edge thereof, or may extend completely across the plate with the two ends of rod 46 extending through flanges 36 on each side to provide the forward pair of pins 38. The central portion of rod 46 is bent in a U-configuration 48 and passes loosely through bracket 50. End 40 of handle 26 is pivotally secured to bracket 50 by nut and bolt 52. Handle 26 may be rotated about the axis through rod 46, in the directions indicated by arrows 54, or about the axis of bolt 52, as indicated by arrows 56.

Referring back to FIG. 4, when plate 24 is in the closed position, rotation of handle 26 about the axis through rod 46 in a counterclockwise direction is constrained by contact of end 40 of the handle with the underside of plate 24. That is, with plate 24 in a substantially horizontal plane, handle 26 rotates under its own weight about rod 46 until the outermost portion of end 40 of the handle (or of bracket 50) contacts the underside of plate 24. In this position, as clearly seen in FIGS. 4 & 5, manually engageable end 42 is positioned directly in the upper central part of the open front of the fireplace. By grasping end 42 and pulling slightly forward, pins 38 at the front edge of plate 24 begin to ride down portions 32 of tracks 28. Continued movement of handle 26 in a forward and downward direction will bring plate 24 to the fully open position, as shown in FIG. 2. Handle 26 may then be rotated upwardly about rod 46 to a position wherein the major portion of the handle is substantially horizontal, and then rotated about bolt 52 to bring end 42 to one side of the fireplace opening, as shown in FIG. 3. In this position the major portion of the handle extends substantially horizontally across the upper part of the fireplace opening and end 42 likewise does not obstruct the opening. Handle 26 may be maintained in the position of FIG. 3 by gravity, i.e., any forces tending to rotate it about either axis are balanced, or cooperating structure (not shown) may be provided at the upper front of the fireplace on one or both sides for releasable engagement of end 42. Handle 26 may also be maintained in the position of FIG. 3 by a suitable frictional fit between end 40 and bracket 50 provided by bolt and nut 52. Upon movement of handle 26 from the position of FIG. 3 back to that of FIG. 2, upward force applied to the handle will move plate 24 back to the closed position.

It is thus apparent that the disclosed damper construction will operate to provide positive sealing of the flue opening while offering a number of other advantages, principal among which is the radiation shielding provided by the damper plate in the open position. Due to the arrangement of the guide tracks and movement of the damper plate thereon, there is no possibility of the damper mistakenly returning to the closed position when the fireplace is in use, as may happen with dampers pivoted within the flue opening. Also as opposed to the more conventional damper constructions, the damper plate in the present invention is not directly in the path of heat or flames passing through the flue opening when the fireplace is in use.

The arrangement and mounting of the handle also provides a number of distinct advantages. When the damper is closed, the manually engagable end of the handle is centrally positioned near the upper front of the fireplace opening, providing a visual indication that the damper must be opened before starting a fire. When the damper is open, the handle position is also distinctive, either extending far down across the front center of the fireplace opening or being retained in a position wherein the major portion extends across the upper front edge and is barely visible. In the latter position, the manually engagable end of the handle is retained at the upper front on one side of the fireplace opening, a relatively cool area so that there is minimal possibility of grasping a hot part when closing the damper after use. It will also be noted that it is never necessary to extend the hand very far into the fireplace opening in manipulating the damper.

What is claimed is:

1. In an open front fireplace structure having a hearth floor, side and rear walls defining a firebox with a flue opening for exhaust of products of combustion, a damper construction comprising:

a. a substantially flat plate having front, rear and side edges for movement between fully covering and uncovering positions with respect to said flue opening, one side of said plate facing said firebox in both positions;

b. a pair of parallel guide tracks each having first portions extending in a front to rear direction on each side of said flue opening parallel to the plane thereof, and second portions extending forwardly from said first portions and downwardly at an acute angle to the horizontal;

c. engagement means by which said plate is supported for sliding movement upon said tracks between said covering and uncovering positions; and d. handle means attached at a first end to said plate and having a second end manually engagable to effect movement of said plate.

2. The invention according to claim 1 wherein said engagement means comprise first and second pairs of guide members affixed to and extending outwardly from said side edges adjacent said front and rear edges, respectively.

3. The invention according to claim 2 wherein said guide members comprise pins, one pin of each pair resting upon each of said tracks for sliding movement thereon.

4. The invention according to claim 3 wherein the length of said first portions of said tracks is at least as great as the distance along said side edges between said pins, whereby all of said pins rest upon said first portions when said plate is in said covering position.

5. The invention according to claim 4 and further including stop means limiting movement of said plate toward said uncovering position, said second pair of pins resting upon said tracks substantially at the juncture between said first and second portions when said plate is in said uncovering position.

6. The invention according to claim 1 wherein at least said one side of said plate is of reflective sheet metal.

7. The invention according to claim 1 wherein said handle means comprises an elongated member pivotally attached at said first end at the center of said front edge for rotation about both a first axis parallel to said front edge and a second axis, perpendicular to said first axis.

8. The invention according to claim 7 wherein said elongated member includes a manually engagable end, opposite said first end, the relative arrangement of said plate and elongated member being such that rotation of said elongated member about said first axis is limited in one direction to position said manually engagable end at the upper center of the frontal fireplace opening when said plate is in said covering position.

9. The invention according to claim 8 wherein said elongated member is pivotable about said second axis to move said manually engagable end to a position adjacent one of said fireplace side walls when said plate is in said uncovering position.

* * * * *